US006367092B2

(12) United States Patent
Cardwell et al.

(10) Patent No.: US 6,367,092 B2
(45) Date of Patent: Apr. 9, 2002

(54) CHARGE TRANSFER CAPACITANCE SENSING AND CONTROL SYSTEM FOR AN INTEGRATED VENTING SYSTEM

(76) Inventors: Troy Cardwell, 29377 Airport Rd.; Casey Cardwell, 4473 Hilton Dr., both of Eugene, OR (US) 97402; Cory Cardwell, 1635 Crescent Ave., Eugene, OR (US) 97408

( * ) Notice: Subject to any disclaimer, the term of this patent is extended or adjusted under 35 U.S.C. 154(b) by 0 days.

(21) Appl. No.: 09/827,039

(22) Filed: Apr. 4, 2001

Related U.S. Application Data

(60) Provisional application No. 60/195,398, filed on Apr. 7, 2000.

(51) Int. Cl.[7] ..... E03D 9/05
(52) U.S. Cl. ..... 4/216; 4/213
(58) Field of Search ..... 4/213, 216, 623, 4/217

(56) References Cited

U.S. PATENT DOCUMENTS 3,849,808 A * 11/1974 Olson et al. ..... 4/213
5,253,371 A 10/1993 Slawinsky
5,730,165 A * 3/1998 Philipp ..... 4/623
6,019,862 A 2/2000 Cardwell et al.
6,279,173 B1 * 8/2001 Denzin et al. ..... 4/213

* cited by examiner

*Primary Examiner*—Charles R. Eloshway
(74) *Attorney, Agent, or Firm*—Robert E. Howard

(57) ABSTRACT

A capacitance charge transfer sensing and control system for a venting system. Preferably the sensing and control system is used with a toilet having an integrated venting system which includes ducting communicating with an exhaust air passageway located in the toilet bowl and an exhaust fan to draw air from the bowl and exhaust it outside. A sensing electrode, such as a wire antenna, is located in a covered location adjacent the toilet bowl, preferably in the exhaust air passageway located in the bowl of an integrated toilet venting system. The wire antenna is connected to a detection and motor control circuit which can detect a change in capacitance of the wire antenna upon a person entering into close proximity thereto. A micro-controller in the detection and motor control circuit is programmed to generate a circuit closing signal to an electric switch located in the circuit between a power source and the exhaust fan in response to a minimum pre-selected increase in the capacitance of the wire antenna. The micro-controller is programmed to open the circuit between the power source and the exhaust fan when there is a pre-selected decrease in the capacitance of the wire antenna and a pre-selected period of time has elapsed after such decrease.

13 Claims, 5 Drawing Sheets

CHARGE TRANSFER CAPACITANCE SENSING AND CONTROL SYSTEM FOR AN INTEGRATED VENTING SYSTEM

CROSS-REFERENCE TO RELATED APPLICATIONS

This application claims the benefit of U.S. Provisional Application Ser. No. 60/195,398, filed Apr. 7, 2000.

BACKGROUND OF THE INVENTION

This invention relates to a sensor and control system for actuating the exhaust fan of a ventilation system. In particular, the invention relates to a sensor and control system for actuating the exhaust fan of an integrated toilet exhaust system.

Many toilet exhaust systems have been proposed. Some are retrofit systems and some are "integrated" systems, i.e., substantially formed as part of the toilet during manufacture. An example of the integrated type of toilet exhaust system is described in U.S. Pat. No. 6,019,862.

Some of these systems use manual exhaust fan actuation means, such as a wall switch.

Some systems use pressure plate type switches located between the upper rim of the toilet and the toilet seat which complete the circuit to the exhaust fan upon someone sitting on the toilet seat and open the circuit when the person gets off the seat. This is the type of activation means disclosed in U.S. Pat. No. 6,019,862, which refers to U.S. Pat. No. 5,253,371 for a more complete description.

The manual actuation means suffers from the problem of people forgetting to turn the switch on at the time they sit down on the toilet or forgetting to turn it off after completing their use of the toilet.

The pressure plate type actuation means is at least automatic, but suffers from soiling and frequent breakdown.

SUMMARY OF THE PRESENT INVENTION

It is an object of the present invention to provide automatic means for actuating a toilet exhaust system.

It is a further object of the present invention to provide a toilet exhaust actuation means that has no moving parts, which eliminates or reduces maintenance problems.

It is a still further object of the present invention to provide a toilet exhaust actuation means that senses the presence of a person before that person commences use of the toilet to actuate the toilet exhaust system and senses the absence of that person after toilet use is finished to deactivate the toilet exhaust system after an appropriate period of time has passed.

These and other objects are achieved by the device of the present invention. The device includes a sensing electrode located adjacent the toilet bowl which is charged to a fixed potential and exhibits an increase in capacitance in response to the presence of a person in close proximity to the toilet. A charge transfer circuit detects and measures the change in capacitance. When the required detection criteria are met a micro-controller in the charge transfer circuit generates a signal to a switch to close the circuit between a power source and the exhaust fan motor of the toilet exhaust system. During the time no signal is being sent to the switch by the micro-controller, the switch opens the circuit between the power source and the exhaust fan motor.

DESCRIPTION OF PREFERRED EMBODIMENTS

Figure 1:
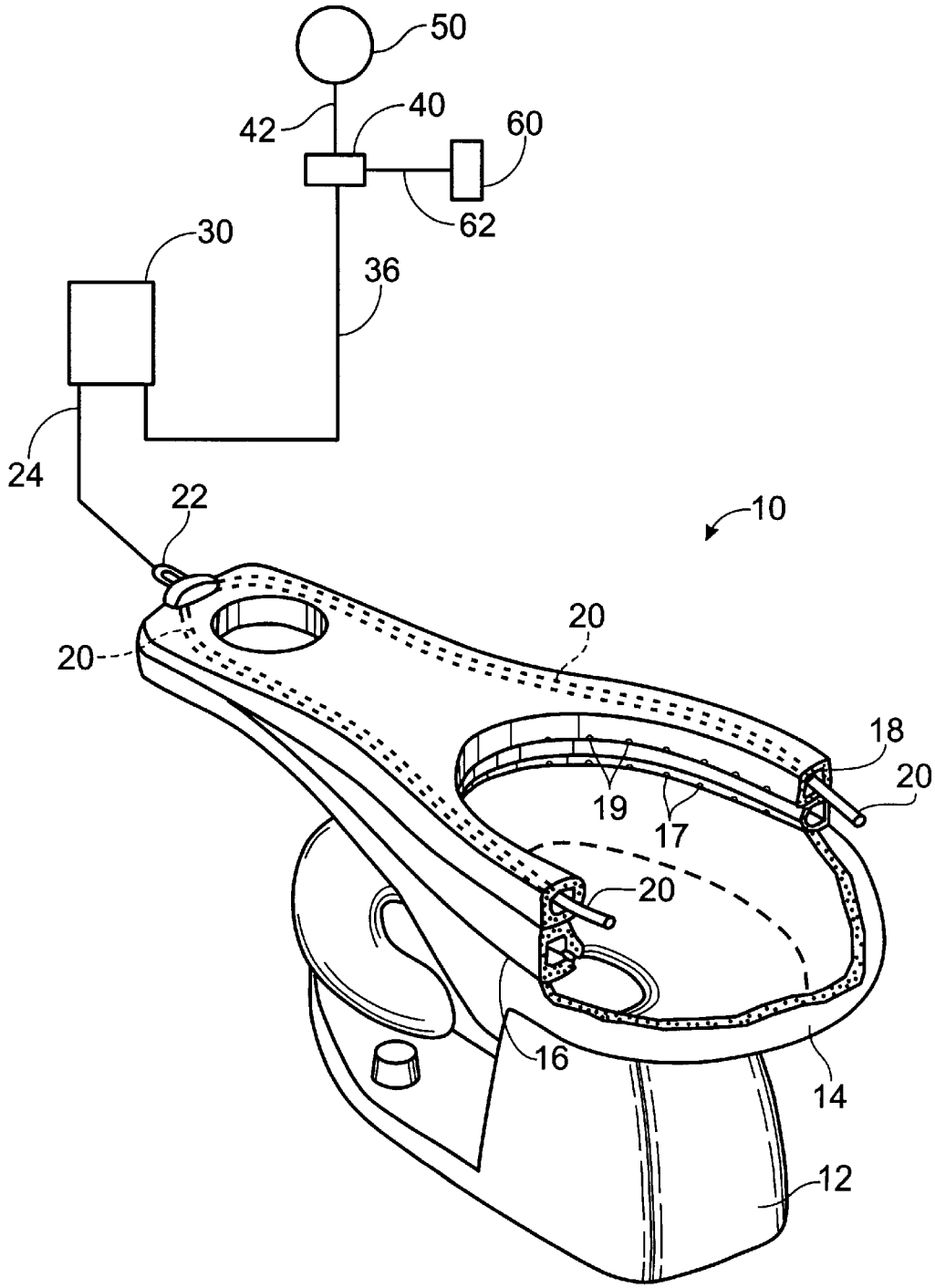
FIG. 1 is a perspective view of a toilet with an integrated exhaust system, partially cut away to show internal details thereof, with associated detection and motor control circuitry, motor switch, fan motor and power source shown in block diagram form.
Figure 2:
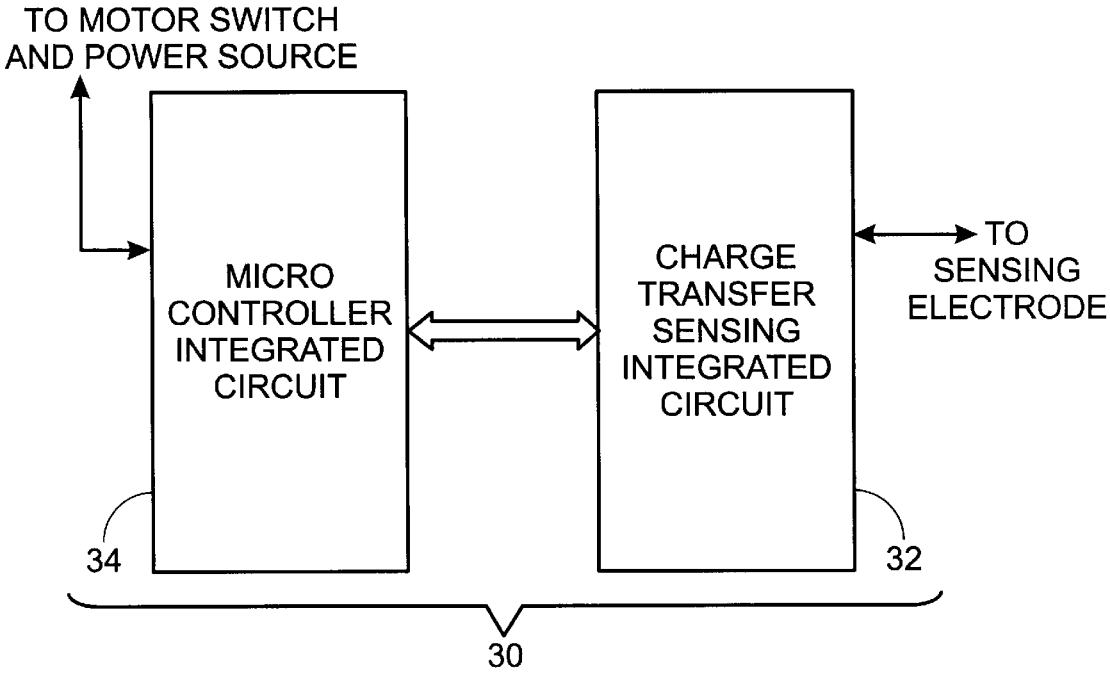
FIG. 2 is a block diagram of the detection and motor control circuitry.

An integrated toilet 10 of the type described in U.S. Pat. No. 6,019,862 will be used for the purpose of illustrating the present invention. However, it is to be understood that the present invention can be used with other types of integrated toilets and retrofit toilets.

Integrated toilet 10 has a base 12, a bowl 14, a water passageway 16 with water outlet openings 17, and an exhaust air passageway 18 with air intake openings 19.

A generally U-shaped sensing electrode 20, which preferably is a conductive, non-magnetic wire antenna, has one leg located inside one side of exhaust air passageway 18 and the other leg located inside the other side of exhaust air passageway 18, as shown. Wire antenna 20 is preferably made of copper. The base 22 of wire antenna 20 extends out of the rear opening of exhaust air passageway 18, at the location to which coupling means communicate exhaust air passageway 18 with the ductwork of an air exhaust system. Wire antenna 20 does not go all the way around the toilet bowl as does exhaust air passageway 18, but each leg thereof terminates at a mid-portion of the toilet bowl opening, as shown.

The capacitance of charged wire antenna 20 increases upon a person coming into close proximity thereto. The physics of such changes in capacitance is well known. By charging sensing electrode 20. (which can be made of anything conductive) to a fixed potential, then transferring that charge to a charge detector comprising another known capacitor, the capacitance of the sensing electrode 20 can be readily ascertained. Any mass moving into proximity to the sensitized electrode 20 will produce a change (increase) in its inherent capacitance.

A detection and motor control circuit 30 includes a charge transfer sensing integrated circuit 32 (hereinafter referred to as the "charge sensing IC 32") and a micro-controller integrated circuit 34 (hereinafter referred to as the "micro-controller 34").

Charge sensing IC 32 is connected to wire antenna 20 by signal and power transmitting wire 24.

Micro-controller 34 is connected to high current motor switch 40 by wiring 36, and high current motor switch 40 is connected to exhaust fan motor 50 by wiring 42.

The detection and motor control circuit 30 and high current motor switch 40 are both connected to DC power source 60 by wiring 62.

Figure 3A:
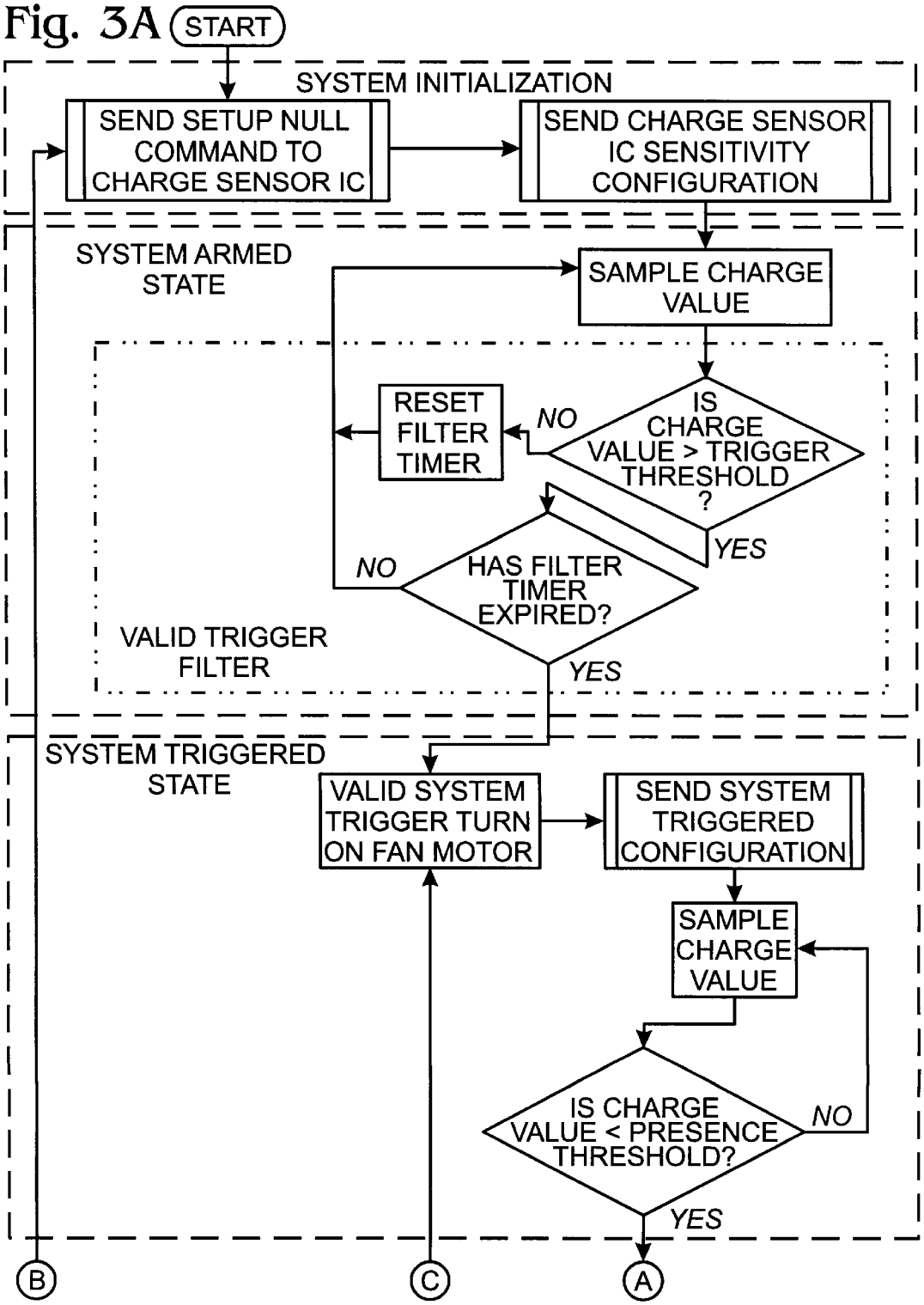
FIGS. 3A and 3B is a process flow diagram of the system of the present invention, FIG. 3B being a continuation of FIG. 3A.
Figure 3B:
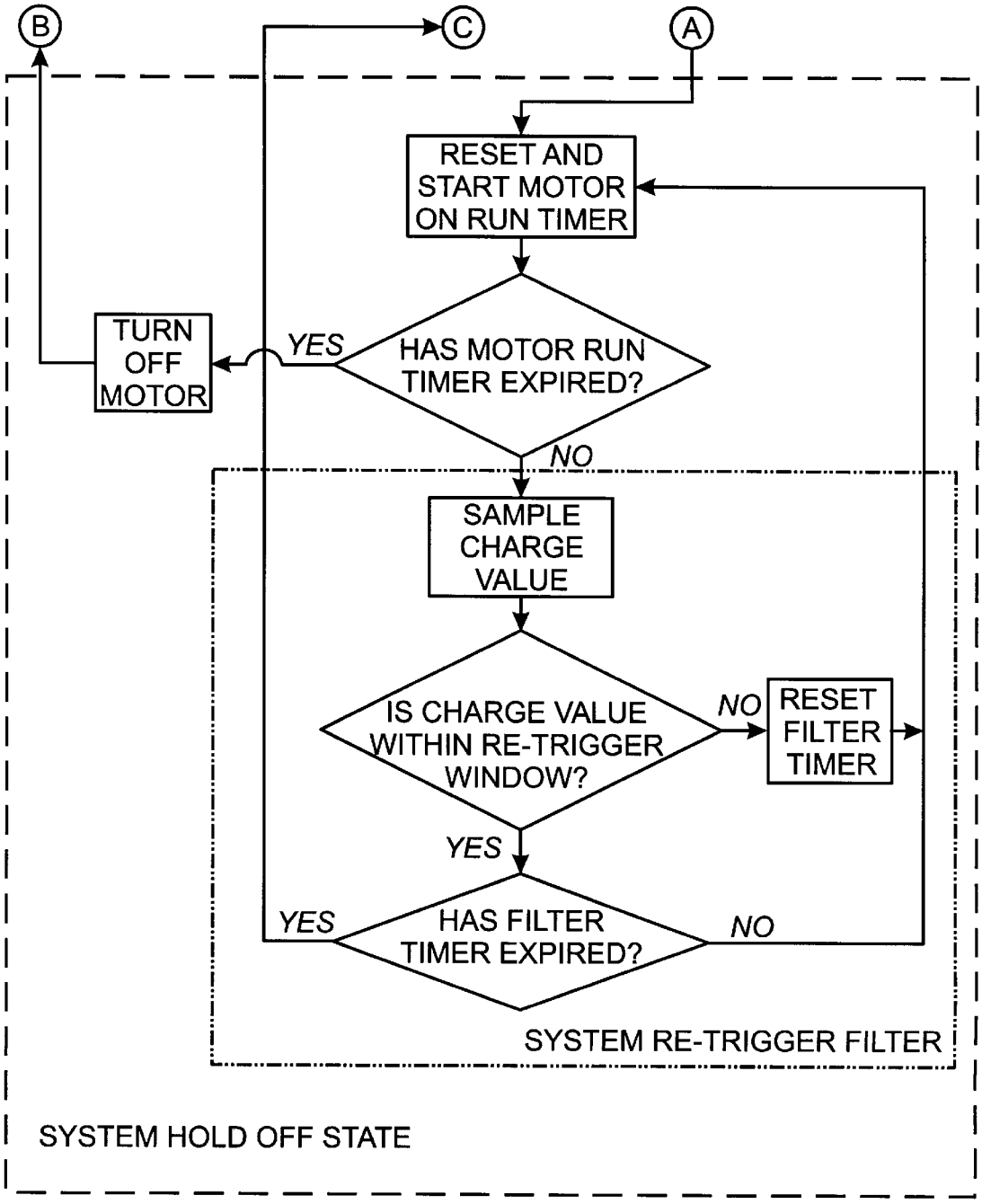

Reference is now made to the system process flow diagram shown in FIGS. 3A and 3B which outline the various system process steps.

When power is first supplied to the detection and motor control circuit 30, the System Initialization Process starts. In the System Initialization Process, micro-controller 34 configures the charge sensing IC 32 to a predetermined state. The charge sensing IC 32 generates a digital output that ranges from a value of 0 to a value of 255. This value corresponds to the relative value of capacitance seen at the wire electrode 20. The micro-controller 34 sends a calibrate command to the charge sensing IC that causes it to null or zero its digital output value. This action taken by the charge sensing IC 32 sets the current charge detection level to zero, in effect nullling out the current or background charge levels. Any change in the charge detected will be relative to the current background charge level.

Micro-controller 34 then sends a command to the charge sensing IC 32 that sets the detection sensitivity to a predetermined value. The sensitivity setting used ensures that contact with the toilet by an individual is necessary for any significant change in the detected charge to occur. This minimizes any false detection that may occur if an individual is merely in close proximity to the toilet 10.

Figure 4:
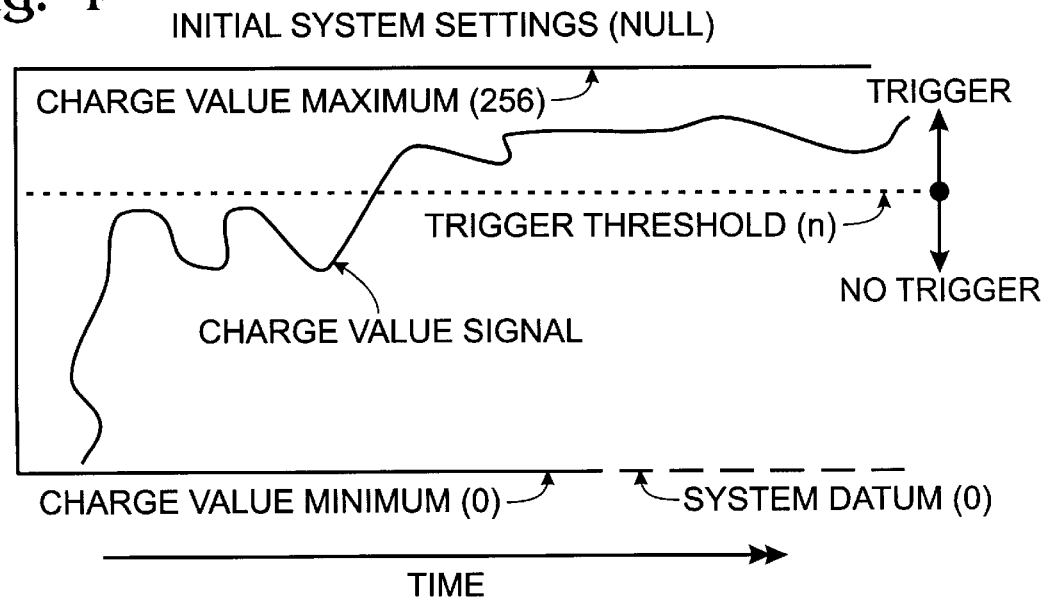
FIG. 4 is a graphical depiction of the initial system settings (null)

Once the System Initialization Process is completed the detection and motor control circuit 30 proceeds to the System Armed State. In the System Armed State micro-controller 34 periodically interrogates the charge sensing IC 32 to determine the current charge detection value. If human contact is made with toilet 10 the charge value will increase. The sensitivity settings of the charge sensing IC 32 are configured in such a manner that significant contact with toilet 10 must be made for the charge value to increase greatly. This would correspond to an individual sitting on the toilet 10. If the charge returned value is greater than a predetermined value, then a possible system trigger exists. The possible system trigger must be further qualified before an actual system trigger can occur. This is done to filter out any inadvertent contact with toilet 10. The filter ensures that the system trigger is valid by requiring the charge value to be greater than the system trigger threshold for a fixed period of time. If at any point during this validation process the charge value should fall below the system trigger threshold the filter timer is reset and the system goes back into an interrogation mode. FIG. 4 graphically illustrates the relationship between the actual charge value signal and the system settings.

Figure 5:
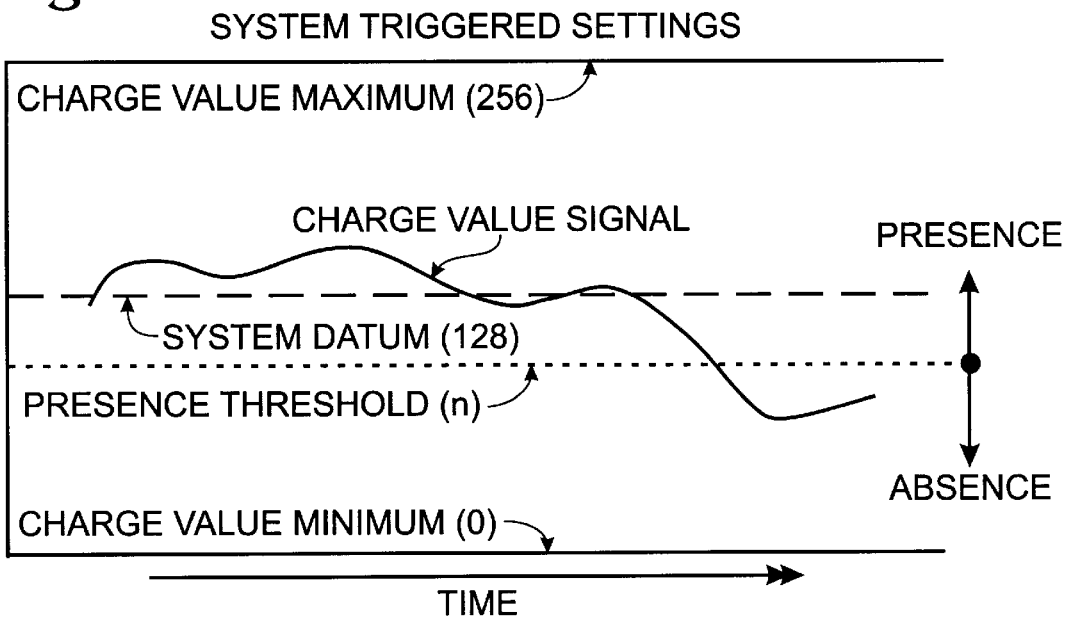
FIG. 5 is a graphical depiction of the system triggered settings.

When all the conditions are met, and the system has qualified that a valid trigger does exist, the system will enter a System Triggered State. In the System Triggered State micro-controller 34 generates the necessary signal to activate fan motor switch 40 which allows power to flow to exhaust fan motor 50. Micro-controller 34 will then send the charge sensing IC 32 a set of commands to first null the charge value output to compensate for the particular individual sitting on toilet 10. When that operation is completed a command will be sent to the charge sensing IC 32 to insert an offset in the charge value so that the charge signals datum will be set to a value of 128. In this configuration it will be possible to detect both an increase and decrease in the capacitance of wire antenna 20. Micro-controller 34 will now commence polling the charge sensing IC 32 for a decrease in the charge value. A decrease in the charge value below a predetermined threshold will indicate that the individual is no longer in contact with toilet 10. The system then exits the System Triggered State. FIG. 5 graphically illustrates the relationship between the actual charge value signal and the system settings in the System Triggered State.

Figure 6:
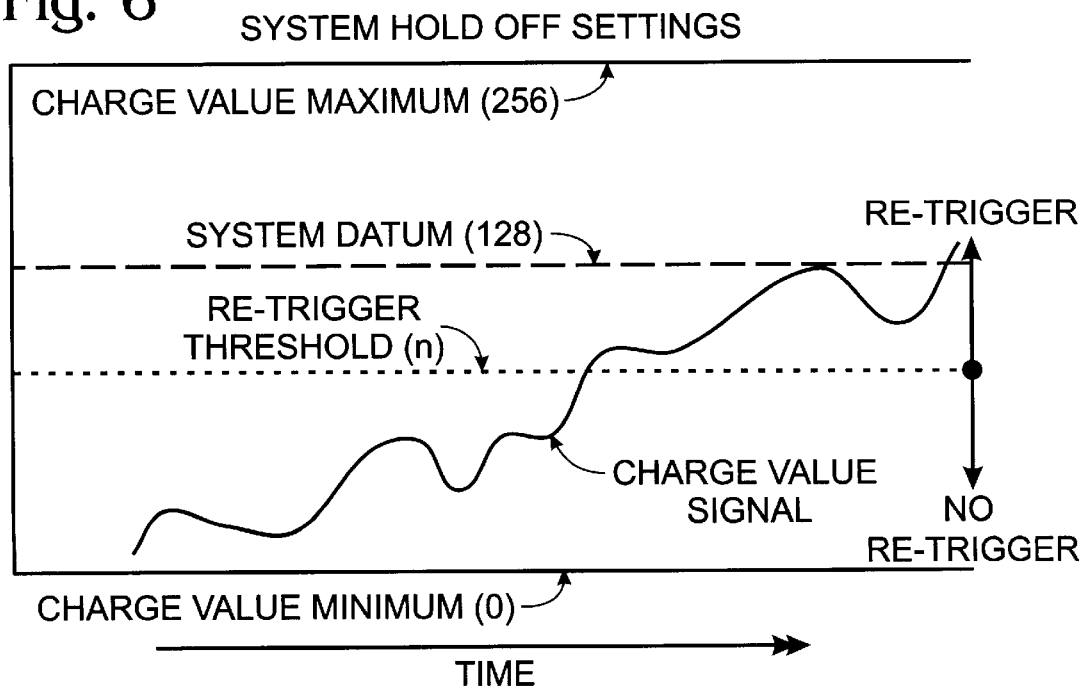
FIG. 6 is a graphical depiction of the system hold off settings.

The application requires that exhaust fat motor 50 continue to operate for a fixed period of time after the individual is no longer in contact with toilet 10. This requirement is met by the System Hold Off State. When the System Hold Off State is entered fan motor So is still operating. Micro-controller 34 first sets up an internal timer for a predetermined period of time. Upon expiration of the predetermined period of time micro-controller 34 will remove the fan actuation signal. In this mode another trigger event could occur. During the period that the timer is active micro-controller 34 again polls charge sensing IC 32 for the current charge value. If the returned charge value becomes greater than the current trigger threshold a system re-trigger is detected. As with the initial trigger event that occurs in the System Armed State, the System Hold Off State employs a trigger filter algorithm. Again, this filter algorithm provides an amount of noise immunity for the detection of false re-trigger events. This filter operates in the same manner as the trigger valid filter that resides in the System Armed State. If a valid re-trigger event is detected the system transitions back to the System Triggered State. The fan motor 50 ON signal is reasserted and the fan motor 50 ON timer is disabled. The System Hold Off State is reentered only when the necessary conditions exist to exit the System Triggered State. If a re-trigger condition is not detected in the System Hold Off State, the fan motor 50 ON timer will expire. At this time the micro-controller 34 will de-assert the fan motor ON signal. The system then transitions back to the System Initialization State where the entire process begins again. FIG. 6 graphically illustrates the relationship between the actual charge value signal and the system settings in the System Hold Off State.

Micro-controller 30 may be any such device programmed to carry out the functions described above. One suitable such programmable device is that manufactured by Quantum Research Company under the trademark "Q-Prox".

High current motor switch 40 may be any switch capable of carrying out the functions described above.

Although wire antenna 20 has been described as being preferably located within the exhaust air duct located in the toilet bowl of an integrated toilet venting system, it may be placed at other substantially covered places adjacent the bowl of a toilet in a location capable of detecting the presence of a person using the toilet, such as being embedded in the toilet seat.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A toilet having a base, a bowl having an interior and a rim, and an air exhaust system for removing air from the interior of said bowl and exhausting it in a region remote from said bowl, said air exhaust system including an air exhaust duct integral with said bowl and extending around said rim of said bowl, said air exhaust duct having an interior in communication with the interior of said bowl, ductwork communicating said air exhaust duct and said region remote from said bowl, and an electric exhaust fan motor connected to a power source through an exhaust fan motor switch, said exhaust fan motor adapted to drive an exhaust fan in communication with said ductwork;

a sensing electrode located within the interior of said exhaust air duct of said bowl; and a detection and exhaust fan motor control circuit in electrical communication with said exhaust fan switch and with said sensing electrode, said detection and motor control circuit adapted to charge said sensing electrode and to detect changes in the capacitance of said sensing electrode;

said detection and exhaust fan motor control circuit adapted to generate an actuating signal to said exhaust fan motor switch upon detection that the capacitance of said sensing electrode has increased to a minimum triggering level, thereby opening electrical communication between said power source and said electric exhaust fan motor;

said detection and exhaust fan motor control circuit adapted to terminate said actuating signal to said fan motor switch to thereby terminate electrical communication between said power source and said electric exhaust fan motor when said minimum triggering level of capacitance of said sensing electrode is not present.

2. The device of claim 1 wherein said sensing electrode is a conductive, non-magnetic wire antenna.

3. The device of claim 2 wherein said sensing electrode is copper wire.

4. The device of claim 1 wherein said sensing electrode extends partially around the interior of said exhaust air duct.

5. The device of claim 1 wherein said power source is a DC power source.

6. A toilet having a base, a bowl having a rim, and an air exhaust system for removing air from the vicinity of said bowl and exhausting it in a region remote from said bowl, said air exhaust system including an air exhaust duct integral with said bowl and extending around said rim of said bowl, said air exhaust duct having an interior in communication with the interior of said bowl, ductwork communicating said air exhaust duct and said region remote from said bowl, and an electric exhaust fan motor connected to a power source through an exhaust fan motor switch, said exhaust fan motor adapted to drive an exhaust fan in communication with said ductwork;

a sensing electrode located within the interior of said exhaust air duct of said bowl; and a detection and exhaust fan motor control circuit in electrical communication with said exhaust fan switch and with said sensing electrode, said detection and motor control circuit adapted to charge said sensing electrode and to detect changes in the capacitance of said sensing electrode;

said detection and exhaust fan motor control circuit adapted to generate an actuating signal to said exhaust fan motor switch upon detection that the capacitance of said sensing electrode has increased to a minimum triggering level and has remained at said minimum triggering level for a fixed period of time, thereby opening electrical communication between said power source and said electric exhaust fan motor;

said detection and exhaust fan motor control circuit adapted to terminate electrical communication between said power source and said electric exhaust fan motor when said minimum triggering level of capacitance of said sensing electrode is not detected for a fixed period of time.

7. The device of claim 6 wherein said minimum triggering level of capacitance is set to correspond to user content with said toilet.

8. The device of claim 6 wherein said sensing electrode is a conductive, non-magnetic wire antenna.

9. The device of claim 6 wherein said sensing electrode is copper wire.

10. The device of claim 6, wherein said sensing electrode extends partially around the interior of said exhaust air duct.

11. The device of claim 6 wherein said power source is a DC power source.

12. The method of operating an integrated exhaust system for a toilet wherein said toilet includes a bowl having a rim, and an air exhaust system for removing air from the vicinity of said bowl and exhausting it in a region remote from said bowl, said air exhaust system including an air exhaust duct integral with said bowl and extending around said rim of said bowl, said air exhaust duct having an interior in communication with the interior of said bowl, ductwork communicating said air exhaust duct and said region remote from said bowl, and an electric exhaust fan motor connected to a power source through an exhaust fan motor switch, said exhaust fan motor adapted to drive an exhaust fan in communication with said ductwork, the steps comprising:

locating a sensing electrode within the interior of said exhaust air duct of said bowl;

locating a charge transfer sensing integrated circuit in electrical communication with said sensing electrode;

locating a micro-controller integrated circuit in electrical communication with said charge transfer sensing integrated circuit and with said power source and said switch means;

causing said micro-controller to send a setup null command to said charge sensing integrated circuit;

causing said micro-controller to send a command to said charge sensing integrated circuit to set the detection sensitivity to a minimum triggering charge value level;

causing the micro-controller to periodically interrogate the charge sensing integrated circuit to determine the current charge value level;

causing a filter timer to be set for a fixed period of time upon said minimum triggering charge value level being detected by said micro-controller;

causing said micro-controller to generate a fan motor actuation signal upon expiration of said fixed period of time with the charge value remaining above the minimum triggering charge value level;

causing said micro-controller to send a null command to said charge sensing integrated circuit;

causing said micro-controller to send a command to said charge sensing integrated circuit to set the detection sensitivity to a system datum level charge value and setting a presence threshold charge value level that is less than said datum level charge value;

causing the micro-controller to periodically interrogate the charge sensing integrated circuit to determine the current charge detection value;

causing a filter timer to be set for a fixed period of time upon said threshold charge value level or lower charge level being detected by said micro-controller; and causing said micro-controller to terminate the fan actuation signal upon expiration of said fixed period of time with the charge value remaining at or below said threshold charge value level.

13. The process of claim 12 in which said minimum triggering charge value level is set at a value that requires a user to come into contact with said toilet.

* * * * *